United States Patent [19]

Becker

[11] 4,386,654

[45] Jun. 7, 1983

[54] HYDRAULICALLY OPERATED DOWNHOLE OIL WELL PUMP

[76] Inventor: John A. Becker, 449 Peralta Ave., Long Beach, Calif. 90803

[21] Appl. No.: 262,747

[22] Filed: May 11, 1981

[51] Int. Cl.[3] ..... E21B 43/12

[52] U.S. Cl. ..... 166/105.5; 166/106; 166/369; 417/405

[58] Field of Search ..... 166/105.5, 106, 369; 418/48; 417/405; 175/107

[56] References Cited

U.S. PATENT DOCUMENTS

| | | | |
|---|---|---|---|
| 2,464,011 | 3/1949 | Wade | 418/48 |
| 2,810,352 | 10/1957 | Tumlison | 166/105.5 |
| 3,347,169 | 10/1967 | Cronin, Jr. et al. | 418/48 |
| 3,802,803 | 4/1974 | Bogdanov et al. | 418/48 |
| 3,982,858 | 9/1976 | Tschirky | 418/48 |
| 3,990,509 | 11/1976 | Hedgecock et al. | 166/106 |
| 4,011,917 | 3/1977 | Tiraspolsky et al. | 175/107 |
| 4,237,704 | 12/1980 | Varadan | 418/48 |
| 4,241,787 | 12/1980 | Price | 166/106 |

*Primary Examiner*—William F. Pate, III
*Assistant Examiner*—William P. Neader
*Attorney, Agent, or Firm*—William C. Babcock

[57] ABSTRACT

A hydraulically operated downhole pump that is connected to or disposed in a string of tubing, and when operated by pressurized oil from the ground surface, is capable of discharging production fluid, gas, and pressurized oil from the well either separately or in desired combinations thereof. The pump includes an elongate housing preferably of such transverse cross section as to be longitudinally movable through a tubing string, with the pump including universal joint connected upper and lower helical screws that rotate in slidable sealing contact with upper and lower double threaded resilient stator blocks secured to the interior of the housing. As pressurized oil is discharged into the upper end of the housing the upper helical screw and associated stator act as a motor to drive the lower helical screw relative to the lower stator block. As the lower helical screw rotates relative to the lower stator block, the lower helical screw acts as a pump to discharge production fluid from the well upwardly therein either separately or in combination with the pressurized oil depending on the components associated with the pump.

9 Claims, 13 Drawing Figures

HYDRAULICALLY OPERATED DOWNHOLE OIL WELL PUMP

CROSS REFERENCES

The present application is related to the subject matter disclosed and claimed in my co-pending application Ser. No. 128,627, filed in the U.S. Patent Office on Mar. 10, 1980, entitled "Helical Screw Downhole Rotary Pump Assembly."

BACKGROUND OF THE INVENTION

Field of the Invention

Hydraulically Operated Downhole Oil Well Pump.

DESCRIPTION OF THE PRIOR ART

In the past, the production of oil from a well bore that is crooked or has sections that deviate from one another in alignment, has posed a serious problem. In such wells it has been common practice to employ sucker rods that reciprocate a piston in a downhole pump. The sucker rod as it reciprocates is in pressure contact with portions of the tubing string that are out of longitudinal alignment, and as a result of constant reciprocation, particularly where sand is present with the produced fluid, the tubing string in which the sucker rod is disposed has openings worn therein.

Attempts have been made in the past to overcome this operational disadvantage by utilizing a downhole pump that is actuated by a pressurized column of oil, but such pumps due to the precision fit of the metal to metal components thereof have but a limited service period, as said entrained with the produced fluid from the well tends to lodge between the metal to metal parts, with the parts subsequently galling and binding to a degree that they will eventually lock together and render the pump inoperative.

A primary object of the present invention is to supply a hydraulically operated pump that may be connected to a tubing string or moved downwardly through a tubing string to a desired producing position, and the pump when disposed in a tubing string and repairs are needed on the pump capable of being unseated and brought to the ground surface by reversing either the flow of produced fluid thereto or reversing the flow of pressurized oil to the pump.

Another object of the invention is to provide a hydraulically operated pump that has an extremely simple mechanical structure, and includes an elongate housing in which upper and lower helical screws rotate relative to upper and lower resilient stator blocks, with the upper helical screw acting as a motor when hydraulic fluid from the surface is pumped downwardly thereto under pressure, and this rotation of the upper helical screw being transferred to the lower helical screw to rotate the same relative to the lower stator block, with this rotation resulting in the lower helical screw acting as a pump to discharge a producting fluid to the ground surface either with or without gas that may be present in the well, as well as separately, or in combination with the pressurized oil used in actuating the pump.

Another object of the invention is to provide a hydraulically operated pump that eliminates the necessity for a sucker rod string, permits the pump to be lowered downwardly through a tubing string to a desired location, even though the tubing string may have sections thereof that are crooked, and are out of longitudinal alignment.

A still further object of the invention is to furnish a hydraulically operated pump that requires a minimum of power to operate the same, handles sand with a minimum of abrasive damage, will not plug with sand, and a pump that may be moved upwardly from a producing position in the well bore to the ground surface by reversing the flow of one of the liquids thereto.

Yet another object of the invention is to supply a hydraulically operated downhole pump that requires no service rig in the maintenance thereof, results in a shorter down time for maintenance, discharges production fluid to the ground surface with less frictional resistance than when a sucker rod is used, has a minimum of moving parts, and costs but a fraction of the price of downhole pumps of comparable capacity.

These and other objects and advantages of the invention will become apparent from the following description of a preferred and certain alternative forms of the pump.

SUMMARY OF THE INVENTION

The hydraulically operated pump of the present invention may be secured to the lower end of a tubing string, or be of such transverse cross section that the pump may be moved downwardly longitudinally through a tubing string to a position adjacent on oil producing zone.

Irrespective of whether the pump is secured to the tubing string or disposed in the lower portion thereof, the pump is actuated by pressurized oil pumped downwardly from the ground surface. The pump includes an elongate housing that has an inlet at the top through which the pressurized oil discharges to an upper helical screw that slidably and rotatably engages an upper stationary stator block, with the upper helical screw and stator block cooperating to act as a motor as the pressurized oil is pumped therebetween.

Rotation of the upper helical screw is transferred to a first universal joint and then to a driver assembly. The rotation of the driver assembly is transferred to a second universal joint that rotates a lower helical screw relative to a lower resilient stator block disposed in the housing.

The lower helical screw and lower stator block cooperate to act as a pump to discharge production fluid and in some instances gas from the well to the ground surface, either separately or in combination with the pressurized oil, with the latter being recycled to again actuate the pump.

By the use of different passaged components with the pump, any desired path or paths for the discharge of pressurized oil, production fluid and gas from the well may be elected by the operator. By reversing the flow of the produced fluid to the pump, or by altering the path of pressurized oil to the pump, the pump may be unseated and moved upwardly through the tubing string to the ground surface for maintenance or repairs.

DESCRIPTION OF THE PREFERRED EMBODIMENTS

Figure 1:
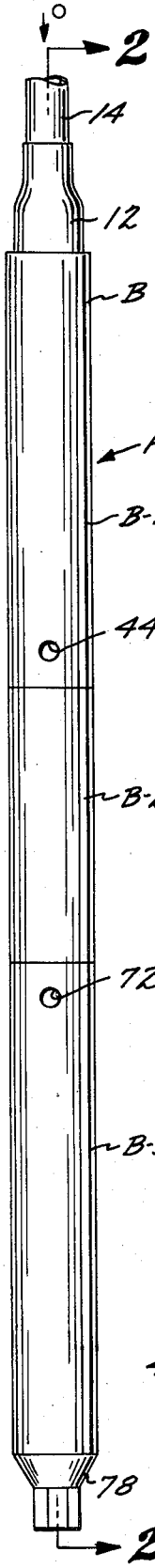
FIG. 1 is a side elevational view of the hydraulically operated pump of the present invention.
Figure 6:
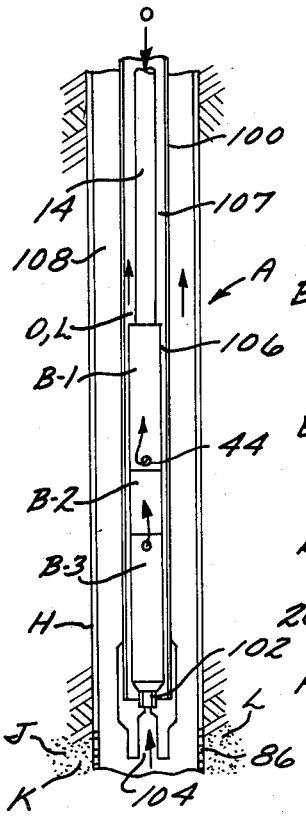
FIG. 6 is a side elevational view of the pump in an oil well bore hole and so operatively associated with a tubing string and casing therein that production fluid and pressurized working oil are discharged concurrently up the tubing string and gas flowing upwardly in an annulus space between the casing and tubing string.
Figure 7:
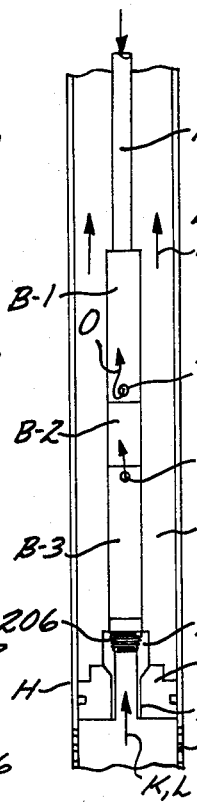
FIG. 7 is a side elevational view of the pump in sealing contact with a packer, with production fluid, pressurized working oil and gas being discharged concurrently up a tubing string.
Figure 8:
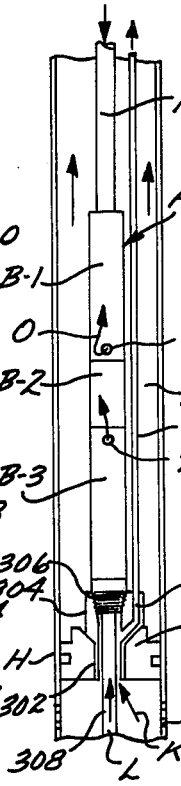
FIG. 8 is a side elevational view of the pump so arranged relative to a tubing string, packer, and conduit that production fluid and pressurized working oil flow upwardly in the annulus space between the tubing string and casing and gas flows upwardly through the conduit.

The oil well pump A that is actuated by pressurized working oil O that is discharged downwardly to the pump from the ground surface is shown in structural detail in FIGS. 1 to 5 inclusive. The pump A as may be seen in FIG. 1 is in communication with the lower end of a first tubing string 14. The tubing string 14 supports the pump A in an oil well bore G as illustrated in FIGS. 6 to 8, which bore has a string of casing H extending downwardly therein, and the lower end portion of the casing by perforations 86 or other conventional passage means being in communication with a fluid producing geological zone J. The zone J contains the production fluid L, that normally will be a mixture of water and oil, and usually some gas K. The tubing string 14 supports the pump A shown in FIGS. 1 to 5 inclusive, adjacent the producing zone J illustrated in FIG. 6.

Figure 2:
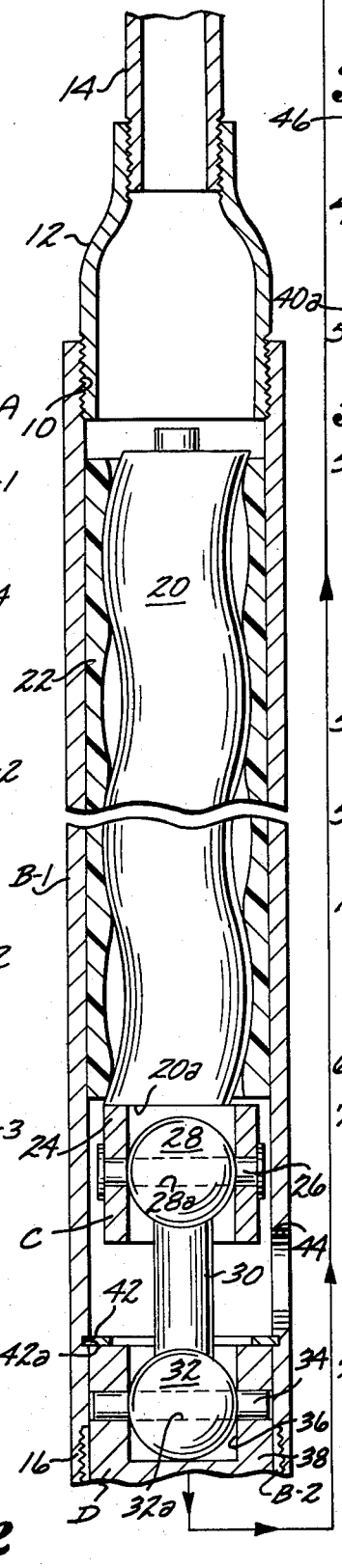
FIG. 2 is a longitudinal cross sectional view of the pump illustrated in FIG. 1 taken on the line 2—2 thereof.
Figure 2:
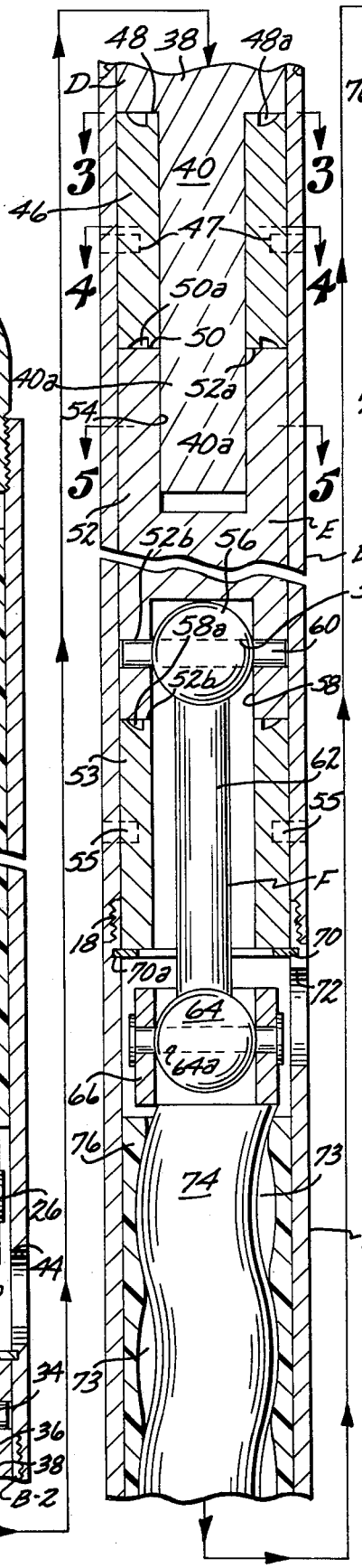
Figure 2:
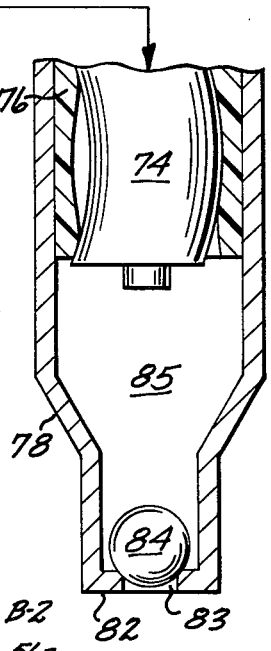

The hydraulic pump A includes an elongate tubular housing B made up of an upper section B-1, an intermediate section B-2, and a lower section B-3. In FIG. 2 it will be seen that internal threads 10 are defined on the upper portion of the section B-1 and engage external threads on a tubular reducer 12, which reducer on the upper end is threadedly connected to the first tubular string 14.

In FIG. 2 it will be seen that threads 16 serve to removably connect the upper housing section B-1 to the intermediate section B-2. Also, threads 18 shown in FIG. 2 serve to connect the intermediate section B-2 to the lower section B-3. The pump A includes an elongate upper helical screw 20 that has a lower end 20*a* and rotates relative to a tubular resilient stator 22 that has double threads defined on the interior thereof, when pressurized fluid O is discharged downwardly through the first tubing string 14, it is forced to flow between the helical screw 20 and stationary stator 22 through passages 23 shown in FIG. 2, and in so doing the screw 20 is rotated in a first direction relative to the stator 22. The stator is held in a fixed position within the upper housing section B-1 by conventional means (not shown). The lower end 20*a* of the upper elongate helical screw 20 is rigidly connected to the upper end of a collar 24 as shown in FIG. 2. The collar 24 forms a part of a first universal joint C. The collar supports a transverse pin 26 that extends through a diametrical bore 28*a* in a first ball 28.

A first rod 30 extends downwardly from the first ball 28 to a second ball 32 which has a bore 32*a* extending diametrically therethrough that is engaged by a transverse pin 34 that extends across a recess 36 formed in the upper portion of a driver D. The driver D includes a rigid cylindrical body 38 that has the recess 36 in the upper portion thereof. A rod 40 extends downwardly from the cylindrical body 38 with the rod adjacent the cylindrical body 38 being of transverse circular cross section, but the rod below this portion having a section 40*a* that is of non-circular transverse cross section, preferably hexagonal. The driver D is prevented from moving upwardly in the housing B by a snap ring 42 that is in abutting contact with the upper end of the driver, and the snap ring being removably seated in a groove 42*a* formed in the upper housing section B-1. After pressurized oil O has rotated the upper elongate helical screw in a first direction relative to the stator 22, the oil discharges downwardly and exits through the opening 44, which opening is shown in both FIGS. 1 and 2.

A cylindrical bearing 46 is held in a fixed position in the intermediate section B-2 as may be seen in FIG. 2 by a number of screws 47. The bearing 46 has an upper ring shaped end 48 in which a number of circumferentially spaced recesses 48*a* are formed. Likewise, the bearing has a lower ring shaped end 50 in which a circumferentially spaced recesses 50*a* are formed. The purpose of the recesses 48*a* and 50*a* will later be explained. The intermediate housing section B-2 serves to rotatably support a driven connector E as may be seen in FIG. 2, which connector is defined by a cylindrical body 52 that has an upper end 52*a* and a lower end 52*b*. A recess 54 of non-circular transverse cross section extends downwardly in the driven connector E from the upper end 52*a* thereof. The recess 54 is slidably but non-rotatably engaged by the section 40*a* of non-circular transverse cross section of the rod 40 that forms a part of the driver D.

A lower end 52*b* of the driven connector E is in rotatable engagement with a sleeve 53 that is held in a fixed position within the intermediate section B-2 by screws 55 or other suitable fastening means. The lower end of the sleeve 53 is in abutting contact with a snap ring 70 as may be seen in FIG. 2, that removably engages a transverse circumferentially extending recess 70*a* formed in the lower housing section B-3. A number of circumferentially spaced recesses 53*a* are formed in the upper end of the sleeve 53 as may be seen in FIG. 2.

A second universal joint F is situated within the housing B as may be seen in FIG. 2, with the second universal joint including a third upper ball 56 that has a bore 56*a* extending diametrically therethrough that is pivotally engaged by a pin 60 that spans a recess 58 formed in the lower portion of the driven member E. The third ball 56 has a rod 62 extending downwardly therefrom to a fourth ball 64 that also has a bore 64*a* extending diametrically therethrough. The fourth ball 64 is disposed within the confines of a circular collar 66. The bore 64*a* is pivotally engaged by a pin 68 that extends transversely across the collar. The snap ring 70 removably engages a circumferentially extending recess 70*a* formed in the lower housing section B-3, and assists the screws 55 in maintaining the sleeve 53 at a fixed longitudinal position within the intermediate housing section B-2. An opening 72 is formed in the lower housing section B-3 as shown in FIG. 2 and permits the discharge of oil well fluid L therethrough as will later be explained.

The lower end of the collar 66 is secured to the upper end of a lower elongate helical screw 74, with the screw 74 rotating within a resilient tubular stator 76 that has double threads formed on the engaging surface thereof. The lower helical screw 74 as it is rotated in a first direction relative to the lower stator 76 by upper screw 20 serves to draw oil well fluid L upwardly through passages 73 defined between the helical screw 74 and the stator 76.

Such upwardly discharging fluid L will flow from the opening 72 that may be seen in both FIGS. 1 and 2. The lower end of the lower housing section B-2 develops into conical section 78 that in turn develops into a tubular member 80 that has a lower end from which a ring shaped lip 82 extends inwardly. The ring shaped lip 82 on the interior thereof defines an inlet 83 for fluid L and gas K from formation J and also serves to define a valve seat on which a ball 84 rests that is of greater density than the density of the fluid produced from the production zone J.

As pressurized hydraulic working oil O is discharged downwardly from the ground surface through the tubing string 14, the working oil O causes the rotor 20 to rotate in a first direction relative to the first stator 22, and this motion being transferred, from the first universal joint C, driver D, driven connector E and second universal joint F to the lower elongate helical screw 74. As the lower elongate helical screw 74 is rotated in a first direction relative to the lower stator 76, a negative pressure is created in the lower interior part 85 of the lower section B-3, and fluid L flows inwardly into the space 85 through inlet 83 by lifting the ball 84 from the seat defined by the lip 82. Fluid L entering the pump 80 may contain finely suspended sand that is highly abrasive, and this sand being ground and reduced to extremely small particles by entering the recesses 48*a* and 50*a*, and being subjected to crushing action as the cylindrical body 38 and the driven connector E rotate relative to the bearing or sleeve 46. The same action occurs when the driven member E rotates relative to the recesses 53*a* formed in the upper portion of the sleeve 53.

When the pump A is used as above described, the working oil O will discharge from the opening 44 and co-mingle with produced fluid L, as the working oil and produced fluid, together with gas, flow upwardly in an annulus space defined between the tubing string 14 and the casing H shown in FIGS. 6 to 13.

The pump A may be used with accessories and additional tubing strings later to be described to define a variety of paths for pressurized oil O, gas K, and produced fluid L to be brought to the ground surface as shown in FIGS. 6 to 13 inclusive, and the pump capable of being unseated and brought to the surface by reversing the flow of one of the fluids thereto as will later be explained in detail.

In FIG. 6 it will be seen that a second tubing string 100 extends downwardly from the ground surface, and has a lower fitting 102 secured thereto, which fitting has an upwardly extending passage 104 therein. The interior transverse cross section of the second tubing string 100 is substantially greater than the transverse cross section of the pump A and a annulus space 106 is defined therebetween which is in communication with an annulus space 107 defined between the tubing string 100 and the first tubing string 14. When pressurized oil O is discharged downwardly through the first tubing string 14 it enters the pump A to drive the upper rotor 20 and discharges from the opening 44 into the annulus space 106, with the oil then continuing to flow upwardly through the second annulus space 107 defined between the first tubing string 14 and the second tubing string 100 to the ground surface. The rotation of the upper rotor drives the lower rotor 74, with production fluid L from zone J being drawn into the pump through passage 106 and inlet 83 by rotation of the lower rotor 74 relative to the lower stator 76, and this production fluid L discharging through the opening 72 into the first annulus space 106 to flow upwardly with the pressurized oil O through the annulus space 107 to the ground surface. When this arrangement of the pump is used, the gas K from formations flows upwardly to the ground surface through a third annulus space 108 defined between the second tubing string 100 and the interior of the casing H.

In FIG. 7 it will be seen that the pump A is used in conjunction with a packer 200 that is located in the casing H above the perforations 86. The packer 200 has a vertical passage 202 extending upwardly therein, which passage may be slidably and removably engaged by a tubular probe 204 secured to the lower end of the housing B by threads 206 or other suitable fastening means.

In the combination shown in FIG. 7, the producing formation J will preferably contain but a small amount of gas. As working oil O under pressure is discharged downwardly to the pump A, it discharges through opening 44 into an annulus space 208 that extends upwardly in the casing H to the ground surface. Operation of the pump will result in production fluid K and gas L being drawn upwardly through the probe 204 into the pump A and discharged through the opening 72 into an annulus space 208 that extends to the ground surface.

In FIG. 8 the pump A is shown as used in conjunction with a packer 300 situated in the casing H above the perforations 86, will be packer having a vertical passage 302 therein. A tubular probe 304 is secured to the lower end of the pump A by threads 306 or other suitable fastening means, with the probe extending downwardly below the packer a substantial distance to define a first passage 308 through which fluid L may flow from the formation J. The probe also defines a second passage 310 for gas K that flows from the formation J. The second passage 310 is in communication with a conduit 312 that extends to the ground surface. When working oil under pressure is discharged downwardly through the conduit 14, the pressurized oil O discharges outwardly from the opening 44 into an annulus space 314 between the tubing string 14 and the casing H. Production fluid L is drawn upwardly by operation of the pump A through the first passage 308 and discharges from the opening 72 into the annulus space 314 to flow with the pressurized working oil O to the ground surface. Gas K from the formation J enters the second passage 310 and flows upwardly to the ground surface through the conduit 312 separate and apart from the working oil O and the production fluid L.

Figure 9:
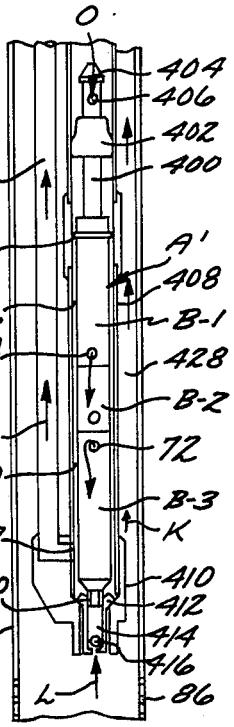
FIG. 9 is a side elevational view of the pump so removably supported in the lower portion of a tubing string that production fluid and pressurized working oil flow upwardly in a conduit and gas flows upwardly in the annulus space between the tubing string and casing.

A modified pump A′ is shown in FIG. 9, that differs from the pump A in that the tubular reducer 12 is eliminated and replaced by a tubular member 400 that extends upwardly and supports a packer 402, with the tubular member having an engageable member 404 secured to the upper extremity thereof. An inlet 406 for pressurized working oil is located in the tubular member 404 intermediate to packer 402 and engageable member 404.

The pump A′ is situated in the lower portion of a tubing string 408 that has an internal diameter greater than that of the pump A′ with the tubing string terminating on the lower end thereof in a fitting 410 that has a seal 412 against which member 80 abuts. The seal 412 has a conventional standing valve S depending downwardly therefrom, which standing valve is situated in a vertical passage 414 formed in the fitting 410. A resilient sealing ring 418 is mounted on the pump A′ above the opening 44 and seals with the interior surface of the tubing string 408. The tubing string 408 and the pump A′ cooperate to define an annulus space 426 therebetween. The tubing string 408 within the fitting 410 has an opening 428 therein that communicates with a conduit 430 that extends upwardly to the ground surface.

When the pump A′ shown in FIG. 9 is used, the pressurized working oil O is discharged downwardly through the tubing string 408 and due to the packer 402 flows through the opening 406, and then downwardly through the tubular member 400 to enter the pump and drive the upper helical screw 20 and discharge through the opening 44 into an annulus space 426. As the lower helical screw 74 rotates production fluid L is drawn upwardly through the standing valve S into the pump A′ to discharge from the opening 72 into the annulus space 426 to flow through the opening 428 into the upwardly extending conduit 430. Gas K from the formation J flows upwardly in an annulus space 420 defined between the tubing string 408 and the casing H.

Figure 10:
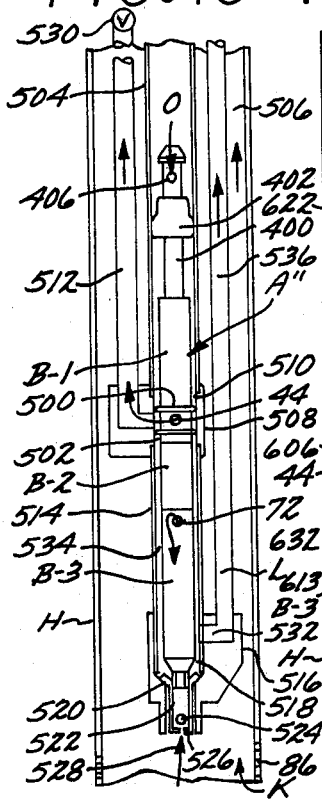
FIG. 10 is a side elevational view of the pump removably supported in the lower portion of a tubing string, with production fluid and working oil flowing upwardly in separate conduits, with gas flowing upwardly in an annulus space between the tubing string and casing, and the pump capable of being unseated by reversing the flow of production oil and pressurizing the latter.

A pump A″ is shown in FIG. 10 that differs from the pump A′ in that the sealing ring 480 is eliminated and replaced by two sealing rings 500 and 502 that encircle housing B above and below the opening 44. A tubing string 504 extends downwardly in the well bore and cooperates with the casing H to define an annulus space 506 through which gas from the formation flows upwardly to the ground surface. The tubing string 504 terminates in a first tubular fitting 508 in which the sealing rings 500 and 502 are slidably and sealing disposed to effect communication between the opening 44, a passage 510 defined within the fitting 508, and a first conduit 512 that communicates with the passage and extends upwardly to the ground surface in the annulus space 506. An extension of tubing string 504 identified in the drawings as 514 extends downwardly from the first fitting 508 to a second fitting 516 that is located adjacent to perforations 86 in the casing H. The second fitting has a downwardly extending recess 518 therein in which the lower end of the pump A is disposed, with the recess having a seal 520 therein that removably and sealingly engages the member 80 of the pump A″. The second fitting 516 has a downwardly extending passage 522 therein, in which a conventional standing valve S secured to the seal 520 is disposed.

In operation, pressurized working oil O is discharged downwardly through the tubing string 504, and due to the packer 402 enters the opening 406 to flow downwardly through the pump A″ to discharge from the opening 44 and the flow upwardly in the conduit 512. As the pump is actuated by this flow of pressurized oil O, the rotor 74 is driven, and draws production fluid L upwardly through the standing valve S and second fitting 516 to discharge the fluid L outwardly through the opening 72. The production fluid L after discharging through the opening 72 flows downwardly through an annulus space 515 defined between the tubing extension 514 and the exterior surface of the housing B of the pump A″ to enter a passage 532 defined in the lower fitting 516 that communicates with a second conduit 534 that extends to the ground surface and through which the production fluid L discharges. Gas K from the formation J flows upwardly in the annulus space 506 from the formation J to the ground surface.

When it is desired to unseat the pump A″ and bring the same to the ground surface, a valve 540 at the ground surface that controls the flow of pressurized oil O from conduit 512 is closed. No pressurized working oil O is discharged downwardly through the tubing string 504. The flow of production fluid L is now reversed, with production fluid L being discharged downwardly under pressure through the second conduit 534. The pressurized production fluid L flows through the passage 532 in the annulus space 515, and bears against the lower sealing ring 502. The fluid L cannot escape from the second fitting 516 due to the standing valve S being closed. The pump A″ now starts to move upwardly in the tubing string 504, but the pressurized production fluid L cannot escape upwardly in the first conduit 512 due to the valve 540 being closed. Accordingly, the pressurized production fluid L as it is discharged from the second fitting 516 flows into annulus space 515 to bear against lower sealing ring 502 and force pump A″ upwardly in tubing string 504 to the ground surface.

Figure 11:
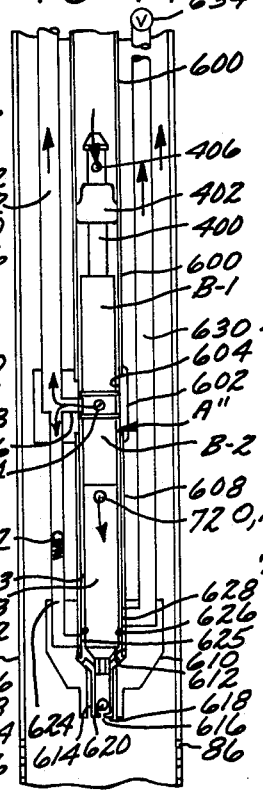
FIG. 11 is a side elevational view of the pump removably supported in the lower portion of a tubing string, and capable of being unseated by reversing the flow of the working oil and pressurizing the latter.

The pump A″ when disposed as shown in FIG. 11 may be unseated and brought to the ground surface by use of the return working oil O when the latter is pressurized and the direction of the flow thereof reversed. In FIG. 11 a tubing string 600 extends downwardly in the casing H and cooperates therewith to define an annulus space 601 therebetween. The tubing string 600 on the lower end has a first fitting 602 secured thereto in which a longitudinal passage 604 is defined. The passage 604 is in communication with the transverse passage 606. An extension 608 of the tubing extends downwardly from the first fitting 602 to a second fitting 610 that has a recess 612 extending downwardly therein, with the pump A″ cooperates with the tubing extension 608 to define a longitudinally extending annulus space 613 that terminates at a sealing ring 617 that encircles the pump body portion B-3 as shown in FIG. 11. The second fitting has a downward extending passage 619 that engages the lower part of tubing extension 618. A seal 623 is disposed in passage 619 and engages the lower end portion of pump A″. A standing valve S of conventional design extends downwardly from seal 633.

Figure 3:
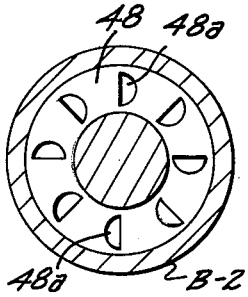
FIG. 3 is a transverse cross sectional view of the pump taken on the line 3—3 of FIG. 2.
Figure 4:
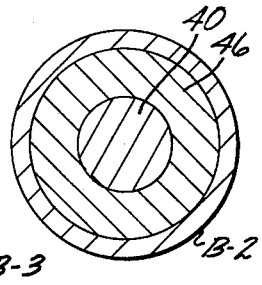
FIG. 4 is a second transverse cross sectional view of the pump taken on the line 4—4 of FIG. 2.
Figure 5:
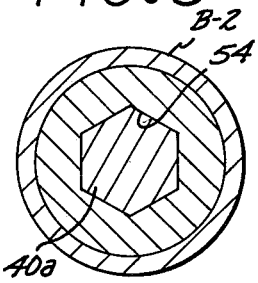
FIG. 5 is a third transverse cross sectional view of the pump taken on the line 5—5 of FIG. 2.

When pressurized working oil is discharged downwardly through the tubing string 600 it enters the opening 406 and flows downwardly through the pump A″ to drive the upper rotor 20 and discharge through the opening 44 into the transverse passage 606 and then upwardly in the first conduit 622 as best seen in FIG. 3. A second conduit 624 is also in communication with the transverse passage 606 and extends downwardly to the second fitting 610 to the interior thereof below sealing ring 617. An opening 628 is formed in the tubing string extension 608 that communicated with the portion of the annulus space 613 above the sealing ring 626, and this opening 628 being in communication with a third conduit 630 that extends upwardly in the annulus space 601 to the ground surface.

As the pump A″ is actuated, production fluid L is drawn upwardly through the standing valve S into the lower portion of the pump A″, and discharges through opening 72 into annulus space 613 to flow therefrom through opening 628 and third conduit 630 to the ground surface. Gas K from formation J flows upwardly through the annulus space 601 to the ground surface.

A spring loaded relief valve 640 is interposed in second conduit 624 and will not open to permit downward flow of returning oil O until the working oil O is above a predetermined pressure. Flow of production fluid L from third conduit 630 may be terminated by closing a valve 650 at the ground surface. When it is desired to unseat pump A″ and move it upwardly through tubing string 600 to the ground surface, valve 650 is closed, and working oil O is discharged downwardly in first conduit 622 at greater than the predetermined pressure at which relief valve 640 opens. No working oil O is discharged downwardly in tubing string 600, the reverse flowing working oil flows from second conduit 624 into the interior of second fitment 610 between the standing valve S and sealing ring 617 to move pump A″ upwardly in tubing string 600.

Figure 12:
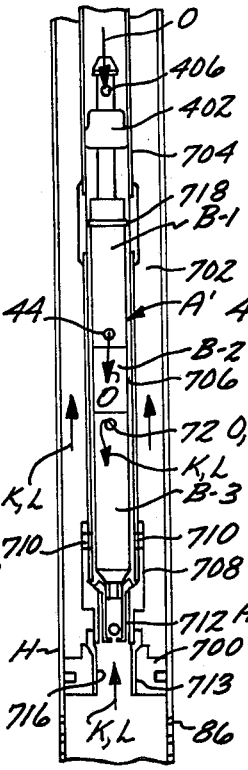
FIG. 12 is a side elevational view of the pump removably mounted in the lower portion of a tubing string adjacent a packer, with the pump discharging working oil, production fluid and gas upwardly in an annulus space between the tubing string and casing.

The pump A′ illustrated in FIG. 9 is shown in FIG. 12 in conjunction with a packer 700 and disposed in the casing H above the perforations 86. In the arrangement shown in FIG. 12 gas K, production fluid L and pressurized working oil O are pumped to the ground surface through a vertically extending annulus space 702 defined between a tubing string 704 and the casing H.

The interior diameter of the tubing string 704 is substantially greater than the external diameter of the pump housing B, and the housing and tubing string cooperating to define an annulus space 706 therebetween. The lower end of the tubing string 704 has a tubular fitment 708 secured thereto that has at least one transverse passage 710 therein that communicates with annulus space 706 and annulus space 702.

The cylindrical member 80 of pump A′ engages a seal 712 in the fitment that forms a part of a standing valve S. The fitment 708 is in engagement with a tubular member 713 that engages a vertical passage 716 in packer 700.

When pressurized fluid O is discharged downwardly in tubing string 704 it enters opening 406 to actuate the pump A′ and flow from opening 44 into the annulus space 706 to exit through passage 710 into annulus space 702 above packer 700. Concurrently, production fluid L and gas K are drawn upwardly through standing valve S into pump A′ to discharge through opening 72 into annulus 706 and then through passage 710 into annulus 702. In the arrangement shown in FIG. 11 all pressurized working oil O, productin fluid L and gas K discharge to the ground surface through the annulus space 702.

Figure 13:
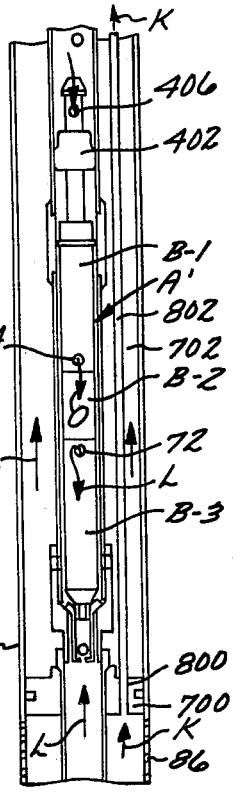
FIG. 13 is a side elevational view of the pump that is similar to that shown in FIG. 12, but with the gas flowing to the ground surface through a separate conduit.

The arrangement illustrated in FIG. 13 operates in the same manner as that shown in FIG. 12, with the exception that packer 700 has a passage 800 extending therethrough that is in communication with a conduit 802 disposed in annulus space 702. Gas K flows upwardly from the formation J to the ground surface through the conduit 802, and production fluid L and pressurized working oil flowing to the ground surface through annulus 702.

The use and operation of the inventions have been explained previously in detail and need not be repeated.

What is claimed is:

1. In combination with a well bore having a string of casing therein that extends downwardly from the ground surface to a position adjacent a geological formation to communicate with the latter, said formation containing production fluid and some gas, a first tubing string of substantially less external diameter than the interior diameter of said casing string that extends downwardly in the latter from the ground surface, said tubing string in communication with a source of pressurized working oil, a hydraulically operated pump disposed in said bore hole adjacent said formation and actuated by said pressurized working oil, said hydraulically operated pump including:

a. an elongate tubular housing having an upper end portion in which a first opening is defined through which said pressurized working oil discharges downwardly and (a) an externally threaded lower (open) end portion having a second opening therein through which said production fluid from said formation may enter the interior of said housing;

b. upper and lower elongate helical screws in said housing that are vertically spaced;

c. upper and lower stationary resilient tubular stators inside said housing that define double threads and that substantially envelop said upper and lower helical screws and are in pressure contact therewith;

d. first means for establishing communication between said first opening in upper end portion and said first tubing, with said pressurized working oil after entering said housing rotating said first helical screw in a first direction to allow said pressurized working oil to flow downwardly in said first stator to discharge through a third opening in said housing below said first stator to subsequently flow to the ground surface in a path within said casing;

e. second means for connecting said first helical screw to said second helical screw to rotate the latter in said first direction relative to said lower stator to draw said production fluid from said bore hole into said housing to subsequently flow to the ground surface in a path within said casing;

f. a threaded probe secured to said threads on said housing, said probe including a tubular member; and g. a packer disposed in said casing above said formation, said packer having a first passage engaged by said tubular member of said probe with pressurized working oil when discharged downwardly through said first tubing string exiting through said third opening into an annulus space between said first tubing string and casing above said packer after having driven said upper helical screw, and production fluid and gas in said bore hole below said packer being drawn upwardly through said tubular member of said probe structure by the rotation of said lower helical screw to discharge into the same annulus space as said pressurized working oil.

2. A hydraulically operated pump as defined in claim 1 which in addition includes:

h. an elongate first standing valve that at least partially defines said lower end portion of said housing, said first standing valve allowing production to flow into said housing but preventing said production fluid downwardly therefrom by gravity.

3. A hydraulically operated pump as defined in claim 2 in which said standing valve has a plurality of angularly disposed elongate faces on the exterior thereof.

4. A hydraulically operated pump as defined in claim 2 in which said first tubing string has a lower threaded end and said housing an upper threaded end, and said first means is a tubular threaded member that engages said threaded end of said first tubing string and said threaded upper end of said housing.

5. A hydraulically operated pump as defined in claim 1 in which said second means includes:

f. a first universal joint in said housing that depends from said first helical screw;

g. a driver rotatably supported in said housing below said first universal joint and connected thereto, said driver including a downwardly extending rod that has an upper section of transverse circular cross section and a lower portion of non-circular transverse cross section;

h. a tubular bearing secured at a fixed position in said housing that rotatably supports said first section of said rod;

i. a generally cylindrical driven member in said housing that is disposed at a fixed longitudinal position therein, said driven member having a downwardly extending cavity of non-circular transverse cross section that is slidably engaged by said second section of said rod;

j. a tubular sleeve disposed at a fixed position in said housing and in rotational abutting contact with said driven member;

k. a second universal joint that depends from said driven member downwardly through said sleeve; and l. a collar secured to an upper end of said second helical screw and to a lower end of said second universal joint.

6. The combination as defined in claim 1 in which said tubular member of said probe structure extends downwardly a substantial distance below said packer to receive production fluid from said formation, and said probe structure having a second passage extending therethrough, and in addition:

h. a conduit within said casing connected to said second passage and extending to the ground surface, and substantially all gas evolved from said formation below said packer flowing through said conduit to the ground surface.

7. The combination as defined in claim 2 in which first tubing string is of greater internal diameter than the external diameter of said tubular housing, said first means being a tube that extends upwardly from housing and communicates with the interior thereof, an engageable member on the upper end of said tube, a packer mounted on said tube below said engageable member, and a fifth opening in said tube between said engageable member and packer, said combination in addition including:

g. a resilient sealing ring that encircles said pump housing above said third opening:

h. a fitment mounted on the lower end of said first tubing string that has a second standing valve there that seals with said first standing valve when said hydraulically operated pump is disposed in said first tubing string adjacent said fitment, said pump housing cooperating with said first tubing string and said sealing ring that is in sealing contact with the interior of said first tubing string to define a ring shaped confined space into which working oil discharges from said third opening, and said production fluid after having flowed upwardly into said pump housing through said first and second standing valves also discharging into said confined space from said fourth opening, said first tubing string within said fitment having an opening therein that is in communication with a passage in said fitment; and i. a conduit connected to said passage that extends upwardly to the ground surface within said casing, said conduit serving to conduct working oil and production fluid to the ground surface, and gas from the formation flowing upwardly to the ground surface in the portion of the casing not occupied by said first tubing string and conduit.

8. The combination as defined in claim 2 in which first tubing string is of greater internal diameter than the external diameter of said tubular housing, said first means being a tube that extends upwardly from housing and communicates with the interior thereof, an engageable member on the upper end of said tube, a packer mounted on said tube below said engageable member, and a fifth opening in said tube between said engageable member and packer, said combination in addition including:

g. a first fitment that is secured to a lower end of said first tubing string and has a first vertical passage extending downwardly therethrough, said hydraulically operated pump partially disposed in said first tubing string and first passage, said first fitment having a first transverse passage that communicates with said first passage;

h. upper and lower resilient rings that encircle said pump housing above and below said third opening that is in communication with said transverse passage, said upper and lower sealing rings slidably and sealingly engaging said first vertical passage and capable of slidably and sealingly engaging the interior surface of said first tubular string;

i. a first conduit that communicates with said transverse passage and extends upwardly in said casing string to the ground surface and through which conduit working oil discharges after flowing through said pump to drive said upper helical screw;

j. a normally open valve at the top of said first conduit;

k. an extension of said first tubing string that depends from said first fitment and has a lower portion of said pump housing therein, said pump housing and extension cooperating to define a first annulus space therebetween below said lower sealing ring;

l. a second fitment secured to the lower end of said first tubing string extension, said second fitment including a second standing valve that communicates with said first standing, said second fitment having a second transverse passage therein that is in communication with said first annulus space, said pump when actuated by pressurized working oil discharged into said fifth opening drawing production fluid upwardly through said first and second standing valves to discharge from said fourth opening into said first annulus space and second transverse passage;

m. a second conduit within said casing string that is in communication with said second transverse passage and through which production fluid flows to the ground surface, with said pump capable of being unseated and moved to the ground surface by ceasing to discharge pressurized working oil down the first tubing string, closing said valve, and pumping production fluid downwardly in the second conduit to bear against said lower resilient ring to force said hydraulically operated pump upwardly in said first tubing string to the ground surface.

9. The combination as defined in claim 2 in which first tubing string is of greater internal diameter than the external diameter of said tubular housing, said first means being a tube that extends upwardly from housing and communicates with the interior thereof, an engageable member on the upper end of said tube, a packer mounted on said tube below said engageable member, and a fifth opening in said tube between said engageable member and packer, said combination in addition including:

g. a first fitment that is secured to a lower end of said first tubing string and has a first vertical passage extending downwardly therethrough, said hydraulically operated pump partially disposed in said first tubing string and first passage, said first fitment having a first transverse passage that communicates with said first passage;

h. upper and lower resilient rings that encircle said pump housing above and below said third opening that is in communication with said transverse passage, said upper and lower sealing rings slidably and sealingly engaging said first vertical passage and capable of slidably and sealingly engaging the interior surface of said first tubular string;

i. a first conduit that communicates with said transverse passage and extends upwardly in said casing string to the ground surface and through which conduit working oil discharges after flowing through said pump to drive said upper helical screw;

j. an extension of said first tubing string that depends from said first fitment and has a lower portion of said pump housing therein, said pump housing and extension cooperating to define a first annulus space therebetween below said lower sealing ring;

k. a second fitment secured to the lower end of said first tubing string extension, said second fitment including a second standing valve that communicates with said first standing valve, said second fitment having a second transverse passage therein that is in communication with said first annulus space, said pump when actuated by pressurized working oil discharges into said fifth opening drawing production fluid upwardly through said first and second standing valves to discharge from said fourth opening into said first annulus space and second transverse passage;

l. a second conduit within said casing string that is in communication with said second transverse passage and through which production fluid flows to the ground surface;

m. a normally open valve on the upper end of the second conduit;

n. a third sealing ring that encircles the portion of said pump housing within said second fitment and said third sealing ring situated below said second tranverse passage and in sealing contact with the interior of said second fitment;

o. an extension of said first conduit that extends down from said first conduit to a third passage in said second fitment that communicates with the interior thereof below said third sealing ring; and p. a spring loaded check valve in said first conduit extension that prevents flow of working oil downwardly therethrough at a pressure it discharges from said third opening, with said hydraulically operated pump capable of being unseated and moved upwardly to the ground surface in said first tubing string by ceasing to discharge pressurized working oil downwardly in said first tubing string, closing said valve, and discharging working oil downwardly in said first conduit and first conduit extension at a pressure sufficient to open said check valve and discharge said working oil into said second fitment under said third sealing ring to force said hydraulically operated pump upwardly in said first conduit.

* * * * *